US007786661B2

(12) United States Patent
Deme et al.

(10) Patent No.: US 7,786,661 B2
(45) Date of Patent: Aug. 31, 2010

(54) EMISSIVE ELECTRODE MATERIALS FOR ELECTRIC LAMPS AND METHODS OF MAKING

(75) Inventors: Istvan Deme, Budapest (HU); Anna Szucs, Jasz-Nagykun-Szolnok (HU); Zsolt Nemeth, Budapest (HU)

(73) Assignee: General Electric Company, Schenectady, NY (US)

( * ) Notice: Subject to any disclaimer, the term of this patent is extended or adjusted under 35 U.S.C. 154(b) by 215 days.

(21) Appl. No.: 12/134,465

(22) Filed: Jun. 6, 2008

(65) Prior Publication Data

US 2009/0302765 A1 Dec. 10, 2009

(51) Int. Cl.
*H01J 1/62* (2006.01)

(52) U.S. Cl. ..... 313/491; 313/633

(58) Field of Classification Search ..... 313/491, 313/633

See application file for complete search history.

(56) References Cited

U.S. PATENT DOCUMENTS

| | | | |
|---|---|---|---|
| 5,111,108 | A | 5/1992 | Goodman et al. |
| 5,138,224 | A | 8/1992 | Golburt et al. |
| 5,585,694 | A | 12/1996 | Golburt et al. |
| 6,166,487 | A | 12/2000 | Negishi et al. |
| 6,384,534 | B1 | 5/2002 | Srivastava et al. |
| 6,600,257 | B2 | 7/2003 | Gaertner et al. |
| 6,603,250 | B2 | 8/2003 | Shaffer |
| 6,680,574 | B1 | 1/2004 | Gaertner et al. |
| 6,713,950 | B2 | 3/2004 | Soules et al. |
| 6,833,659 | B2 | 12/2004 | Gaertner et al. |
| 6,849,996 | B2 | 2/2005 | Venugopal et al. |
| 6,879,091 | B2 | 4/2005 | Venugopal et al. |
| 2002/0195922 | A1 | 12/2002 | Juestel et al. |
| 2004/0239229 | A1 | 12/2004 | Venugopal et al. |
| 2006/0132043 | A1 | 6/2006 | Srivastava et al. |
| 2007/0090764 | A1 | 4/2007 | Ramachandran et al. |
| 2007/0120456 | A1 | 5/2007 | Sommerer |
| 2007/0120482 | A1 | 5/2007 | Michael et al. |

FOREIGN PATENT DOCUMENTS

JP 2005285587 A1 10/2005

OTHER PUBLICATIONS

International Search Report issued in connection with corresponding PCT Application No. PCT/US2009/043963 on Feb. 2, 2010.

*Primary Examiner*—Vip Patel
(74) *Attorney, Agent, or Firm*—GE Global Patent Operation; Peter T. DiMauro

(57) ABSTRACT

Electron emissive compositions comprising a barium neodymium oxide are described. These compositions may be applied to electrodes such that electron emission is facilitated. Methods of manufacturing emissive electrodes comprising a barium neodymium oxide are also described. Various discharge lamps employing such electrodes are described as well.

19 Claims, 4 Drawing Sheets

EMISSIVE ELECTRODE MATERIALS FOR ELECTRIC LAMPS AND METHODS OF MAKING

BACKGROUND

The present disclosure generally relates to emissive electrodes and methods of manufacture. In particular, the present disclosure generally relates to emissive electrodes comprising a barium neodymium oxide, lamps comprising same, and methods of manufacture.

There are a number of known methods and types of light sources or lamps. One type of fluorescent lamp is based on ionization of gaseous mercury held at low pressures, usually in the presence of a noble gas fill within an electrode discharge space, to generate UV and/or visible light. Traditionally, mercury-containing fluorescent lamps have been widely used because of their excellent efficiency and good color rendering. Recently, though there are attempts to replace mercury fluorescent lamps by new designs because of the perceived adverse environmental effect of mercury.

Newer methods have been proposed to either replace mercury with other environmental friendly chemicals or to decrease Hg concentration. One method of preparing an essentially mercury-free fluorescent lamp typically utilizes a mixture of gallium halides and/or gallium metal. Other metals and mixtures now employed comprise, e.g., zinc and/or indium, and their iodides and/or chlorides. It is believed that these metal halides offer advantages in that the reasonable vapor pressure of the metal halides can enhance the relatively low vapor pressure of metals in the temperature range of 20-200° C. In operation, these metal halides are excited and either emit UV/visible photons or chemically decompose upon the excitation energy. Furthermore, their products of decomposition emit their characteristic UV/visible spectra in the discharge. It is believed that, during lamp operation and between operation periods, there are metal halides, metal atoms, and halogen molecules/atoms in the gas phase of the lamp.

However, unfavorable interactions have been observed between the different lamp parts (e.g., glass envelope, lead wires, or emissive mixtures, etc.) and the ionized "halide plasma", which contains many chemically strongly reactive species. Such unfavorable chemical interactions have resulted in the formation of colored precipitates on envelope walls, and evaporation of components of the emissive mixtures leads to reduced lamp lifetime. Colored deposits on envelope walls also can decrease light output by its own absorption and can chemically bind the dosed metal and/or halide. Furthermore, in discharge lamps, hot spot temperature can reach 1000-1200° C., and a tungsten wire filament itself can reach 600-700° C., both of which can result in a slow evaporation of components of the emissive mixture material. For instance, a key limiting fact in the use of known Ba/Ca/Sr triple oxides/carbonates emissive mixtures in such systems, is evaporation of Ba. In such mixtures, a relatively high Ba content is applied because of its work function-lowering effect; yet, Ba starts to evaporate at a lower temperature than the other components.

Therefore, despite the efforts described, there remains a need to develop improved emissive materials having lessened chemical interactions between the emissive mixture and the gaseous environments in lamps, and decreased evaporation of components of the emissive mixture.

BRIEF SUMMARY OF THE INVENTION

One embodiment of the present disclosure is directed to an electrode comprising an electrode substrate, and an electron emissive composition operable to emit electrons in response to excitation, the composition comprising a barium neodymium oxide.

Another embodiment of the present disclosure is directed to a lamp comprising a light-transmissive envelope, a discharge fill contained within the envelope, and an electrode comprising an electrode substrate and an electron emissive composition operable to emit electrons in response to excitation, the composition comprising a barium neodymium oxide.

Yet another embodiment of the present disclosure is directed to a method of manufacturing an electron emissive system, the method comprising: (a) blending a composition comprising a barium neodymium oxide and a binder, to form a slurry or suspension: (b) coating the slurry or suspension on a thermal or electrical excitation source to form a coated excitation source; and (c) removing the binder from the coated excitation source.

Other features and advantages of this disclosure will be better appreciated from the following detailed description.

BRIEF DESCRIPTION OF THE DRAWINGS

The following detailed description is made with reference to the accompanying drawings, in which.

DETAILED DESCRIPTION OF THE EMBODIMENTS

Figure 1:
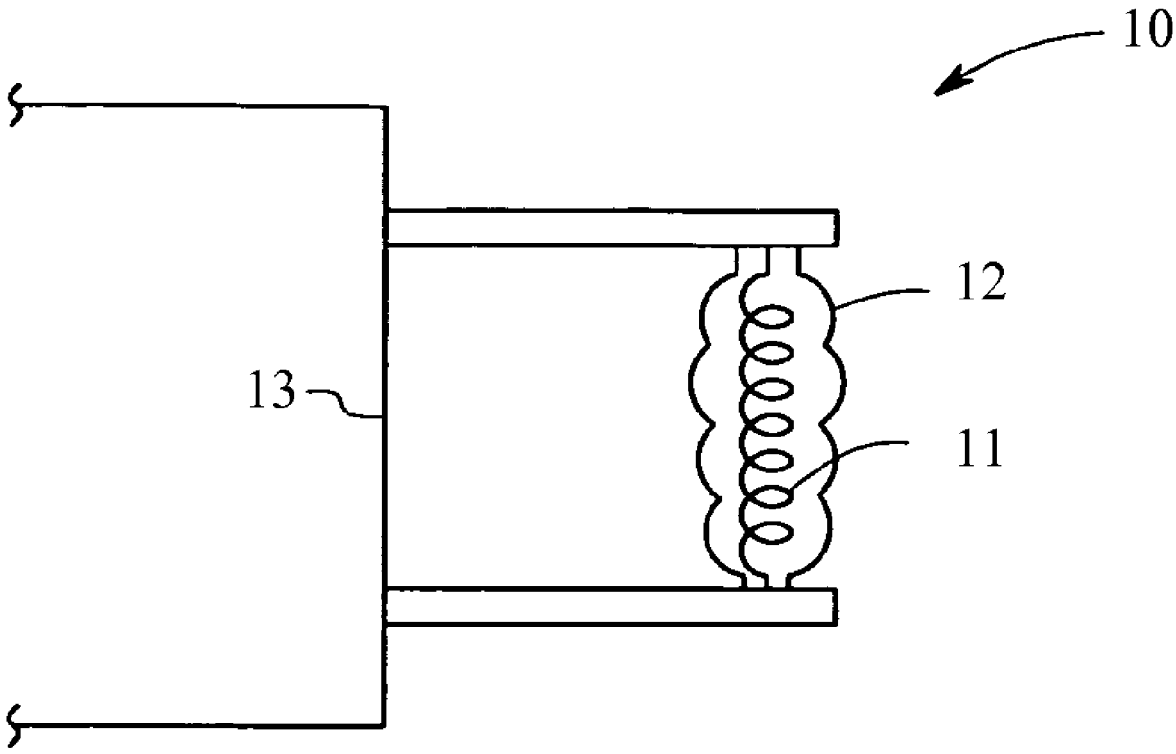
FIG. 1 is a schematic view of an electrode according to illustrative embodiments of the invention.

Disclosed herein are electron emissive compositions comprising a barium neodymium oxide, and their uses as components of emissive electrodes. In particular, disclosed herein are electrodes comprising an electrode substrate and an electron emissive composition operable to emit electrons in response to excitation, wherein such composition comprises a barium neodymium oxide. The use of a barium neodymium oxide as a component of an emissive composition is in contrast with some typical emissive materials, such as the Ba—Ca—Sr carbonates/oxides. By employing a barium neodymium oxide in place of (or in addition to) these typical emissive materials, unfavorable chemical interactions (such as evaporation and reaction with discharge fill materials in discharge lamps) can be minimized. Without being limited by any theory, it is believed that barium is more strongly bound or complexed in a barium neodymium oxide system as compared to barium contained in a triple carbonate/oxide system. This unique feature makes barium neodymium oxide a perfect candidate even in low dose Hg fluorescent system as emission material, where mercury consumption is a critical issue.

It is contemplated to be within the scope of the disclosure to utilize a barium neodymium oxide as an emissive mixture component in a wide variety of lamps, including mercury fluorescent lamps, low dose mercury, and mercury free low-pressure fluorescent lamps.

As used herein, the term "barium neodymium oxide" is intended to refer to a stoichiometric or nonstoichiometric compound of at least the elements Ba, Nd, and O, where the atomic ratio of Nd:Ba is about 2.0. As would be understood by a person having ordinary skill in the art, a "barium neodymium oxide" would not generally include a mere chemical mixture of barium oxides and neodymium oxides. In some embodiments, a barium neodymium oxide may be non-stoichiometric. For example, such a barium neodymium oxide may have some oxygen deficiency. For example, an oxygen-deficient barium neodymium oxide may be represented by the formula $BaNd_2O_{4-x}$ where x is >0 and less than about 0.2. However, in other embodiments where x=0, the compound does not have oxygen deficiency, and has the formula $BaNd_2O_4$. Without being limited by theory, such oxygen deficiency (when present) may be correlated with excess barium and/or neodymium being present, acting as dopants and leading to increased electrical conductivity and possibly enhanced electron emission.

According to embodiments of the invention, barium neodymium oxide is incorporated an electron emissive composition operable to emit electrons in response to excitation. As used herein, the term "excitation" may comprise thermal excitation or electrical excitation, or combinations thereof. For instance, thermal excitation leading to thermionic emission is the process by which materials emit electrons or ions upon application of heat. The work function of a material plays a role in determining the level of electron emission for a given thermal excitation. In some embodiments, the barium neodymium oxide composition may also be capable of field emission. Field emission is a form of quantum tunneling in which electrons pass through a barrier in the presence of a high electric field.

An electron emissive composition in accordance with embodiments of the invention may consist of, or may consist essentially of barium neodymium oxide; or, such composition may comprise other substances in addition to the barium neodymium oxide. Such other substances which may be present include other electron emissive materials, such as one or more of an alkaline earth oxide and an alkaline earth carbonate, (for example, one or more of BaO, CaO, SrO, $SrCO_3$, $CaCO_3$, $BaCO_3$); or the like. Yet other substances which may be present in such composition include one or more of metallic materials, metal oxides, mixed metal oxides, metal alloys, ferroelectric materials, or the like. Such metallic materials and metal alloys may include, for example, one or more of metallic W, Ta, Pt, Th, Ti, Ni, V, Hf, Nb, Mo, Zr, Re, and combinations and alloys thereof. Metal oxides and mixed metal oxides may include, for example, oxides and mixed oxides of Ta, Ti, Al, Y, W, La, Th, Zr, Zn, Hf, and combinations thereof, or the like. Some free $Nd_2O_3$ may also be present. In other embodiments, the barium neodymium oxide may be the sole substance in the electron emissive composition that is capable of being electron emissive.

In accordance with typical embodiments, an electron emissive composition comprising a barium neodymium oxide may contain a barium neodymium oxide in a range from about 1% to 100% by weight of the total electron emissive composition. In other embodiments, a barium neodymium oxide may be present in a range from about 25% to about 75% by weight of the total electron emissive composition. In certain other embodiments, a barium neodymium oxide may be present in a range from about 40% to about 60% by weight of the total electron emissive composition. Other values in these ranges are intended to be within the scope of the invention. All ranges disclosed herein are inclusive of the recited endpoint and independently combinable.

According to embodiments of the present invention, an electrode may comprise an electrode substrate. Typically, but not always, the electron emissive composition is in contact with the electrode substrate. An electrode substrate may comprise a metallic material selected from the group consisting of W, Ta, Pt, Th, Ti, Ni, V, Hf, Nb, Mo, Zr, Re, and combinations and alloys thereof, or the like. The electrode substrate may have any desired shape. It may be 1-dimensional, 2-dimensional or 3-dimensional or any suitable fractional dimension up to about 3. Suitable examples of 1 dimensional substrate are linear filaments, non-linear filaments such as circular filaments, elliptical filaments, coiled filaments or the like. Suitable examples of 2-dimensional substrates are flat plates, flat or curved sheets, and the like. Suitable examples of 3-dimensional substrates are hollow spheres, cups, beads, and the like. It may also be possible to use substrates having a combination of 1, 2, or 3-dimensional geometries. One non-limiting example of a substrate is a tungsten filament. The electrode may be an anode, a cathode, or both an anode and a cathode; and, any of these types of electrodes may be in a lamp or other discharge device.

In certain embodiments of the invention, a mixture comprising an electron emissive composition comprising a barium neodymium oxide may be generally coated onto an electrode substrate, and thereafter typically is sintered. The coating of the substrate may be carried out by any one or more of a variety of conventional coating processes, such as dip coating, spray painting, electrostatic painting, painting with a brush, or the like. In one embodiment, a thickness of an electron emissive composition coating comprising a barium neodymium oxide, may be from about 3 micrometers to about 100 micrometers, after sintering. In another embodiment, the coating thickness may be from about 10 micrometers to about 80 microns. In yet another embodiment, the coating thickness may from about 15 micrometers to about 60 micrometers.

In various other embodiments of the invention, the electron emissive composition may be disposed in a variety of ways. For instance, the electron emissive composition may comprise particles comprising a core material and a shell material. In a non-limiting example, the core material comprises a barium neodymium oxide composition and the shell material comprises any other emissive material (e.g., a triple oxide composition such as (Ba,Sr,Ca)O). In another non-limiting example, the core material comprises any other emissive material, and the shell material comprises a barium neodymium oxide composition.

Alternatively, the electron emissive composition may be disposed in a ceramic or metal cup, or disposed as a coating on a metal foil or filament. In a yet further alternative embodiment, a metal coil may be wrapped around a core structure which includes the electron emissive composition. In some yet further alternative embodiments, the electrodes of the invention may comprise a sintered solid composite comprising the electron emissive composition, or may comprise a graded composite of the electron emissive composition and at least one metal. When in a graded composite structure, the center of such a composite structure may be made with greater than 50% barium neodymium oxide concentration per unit volume and the outer edges may be made with greater than 50% metal concentration per unit volume.

Finally, in another alternative embodiment, the electron emissive composition comprising a barium neodymium oxide may be embedded inside pores of a porous refractory material, such as a refractory metal. As is generally known, refractory metals are a class of metals typified by resistance to heat, wear and corrosion and generally with high melting points (e.g., greater than 1800° C.).

An electron emissive composition comprising a barium neodymium oxide according to embodiments of the present invention may be made by a variety of methods utilized in the fields of ceramics and metallurgy. Suitable examples of such manufacturing processes include a reactive milling method, a sol-gel method, wet chemical precipitation, vapor deposition, molten-salt synthesis and mechano-chemical synthesis. In general, a source of barium, a source of neodymium, and a source of oxygen are combined and then converted, in one or more step, to a barium neodymium oxide. In many cases, the source of barium and/or neodymium may also be a source of oxygen (such as when the source of barium is an oxygen-containing barium salt, for example, barium carbonate). In other cases the source of oxygen is $O_2$. Combinations of oxygen sources, barium sources, and neodymium sources are also possible.

Typical sources of barium may include a barium compound such as a halide, carboxylate, nitrate, chlorate, sulfate, oxide or carbonate of barium; or the like. Typical sources of neodymium may include a neodymium compound such as a halide, carboxylate, nitrate, chlorate, sulfate, oxide or carbonate of neodymium; or the like. Any of these sources of barium and/or neodymium may be employed in solid, semi-solid, slurry, or solution form. Generally, the atomic ratio of Ba to Nd in the combined sources employed may be any value effective to produce a barium neodymium oxide after processing onto a substrate; typically, atom ratios of from about 0.8:2 to about 1.2:2 (Ba:Nd) are used; more typically, a substantially stoichiometric ratio is employed.

When employed as a solid material, the metal compounds used in the preparation of the barium neodymium oxide composition may be ground up into desired particle sizes using a combination of shear and compressive forces in devices such as ball mills, Henschel mixers, Waring blenders, roll mills, and the like. Some desired particle sizes generally include sizes in the range of from about 0.2 microns to about 20 microns; more narrowly, from about 0.5 microns to about 10 microns; and even more narrowly, from about 1 micron to about 5 microns.

According to illustrative embodiments of the present invention, either of both of the sources of barium and neodymium employed for making electron emissive compositions comprising a barium neodymium oxide are solids, such as a barium carbonate powder and a neodymium carbonate powder. Such solids may be mixed to form a mixed powder, which may then be subjected to a first sintering process to form a sintered body that comprises the requisite barium neodymium oxide composition. The first sintering process may occur at any temperature effective to convert the sources of barium and neodymium to a barium neodymium oxide, e.g., of from about 900° C. to about 1500° C. for a time of from about 1 hour to about 100 hours. However, other appropriate sintering temperatures and durations may also be used if desired.

In further illustrative embodiments, a sintered body as formed above may be comminuted into a particulate material. Such particulate material may be then combined with a binder and optionally a solvent to form a coating mixture. As noted earlier, an electron emissive composition in accordance with embodiments of the invention may comprise other substances in addition to the barium neodymium oxide. It therefore may be convenient at this point to combine the particulate material and binder and other optional substances prior to forming the coating mixture.

The coating mixture as defined herein may be either a slurry, suspension, solution, paste, or the like. The coating mixture is then coated onto a desired substrate (such as any of the electrode substrates described above), following which it is optionally allowed to dry to form a green coating. The green coating is a coating which generally has less than or equal to about 10 wt % solvent based upon the weight of the wet mixture. The substrate with the coating mixture or the green coating is then heated to form the electron emissive composition. The binders used in the preparation of the coating mixture are polymeric resins, ceramic binders, or combinations comprising polymeric resins and ceramic binders. The coating of the substrate is carried out by processes such as dip coating, spray painting, electrostatic painting, painting with a brush, or the like. As noted above, the coating thickness can typically be about 3 micrometers to about 100 micrometers after sintering. Other coating thicknesses are also suitable.

According to embodiments of the present invention, the coated substrate is generally subjected to second sintering process to remove any remaining solvent and binder and to form a coating of the electron emissive composition on the substrate. The second sintering process may be conducted by heating process such as conduction, convection, radiation such as radio frequency radiation or microwave radiation. In another embodiment, the electrode substrate may be resistively heated to form the electron emissive composition. Combinations of different methods of heating for purposes of sintering, such as for example, convective heating with resistive heating may also be used if desired. The sintering by conduction, convection, radiation, resistive heating or combinations thereof may be carried out at a temperature of about 1000° C. to about 1700° C. Within this range it is generally desirable to use a temperature of greater than or equal to about 1100° C. and less than or equal to about 1650° C. Alternatively, the sintering may be conducted in a multi-stage process if desired.

In a particular embodiment of the invention there is provided a method of manufacturing an electron emissive system, where the method comprises blending a composition comprising a barium neodymium oxide (as provided by the methods noted earlier) and a binder to form a slurry or suspension, and coating the slurry or suspension on a thermal or electrical excitation source to form a coated excitation source, followed by removing the binder from the coated excitation source. It is typical that such methods of manufacturing an electron emissive system further comprise a step of activating the coated excitation source. As would be understood by skilled workers in the field, an activation step is typically carried out by heating the substrate with the coating through a sequence of successively higher temperatures, under conditions effective to form an emissive barium neodymium oxide.

Referring now to FIG. 1, here is shown a side, cross-sectional schematic view of a typical electrode having an electrode substrate, and an electron emissive composition comprising a barium neodymium oxide. In particular, an electrode 10 (often a cathode) can comprise a metal wire or coil 11, such as a tungsten coil, having an electron emissive coating 12 which comprises a barium neodymium oxide. The electrode in typical use is coupled to a ballast 13. Such ballasts are generally used to provide and regulate electric current through the electrode, and also through a gas discharge when the electrode is used in a discharge lamp. It is to be understood by those skilled in the field, that this representation is not to be construed as limiting the possible structures than an electrode according to embodiments of the invention may take.

In accordance with certain embodiments of the invention, there is provided a lamp comprising: an light-transmissive envelope; a discharge fill contained within the envelope; and an electrode comprising an electrode substrate and an electron emissive composition operable to emit electrons in response to excitation, wherein the composition comprises a barium neodymium oxide. The electron emissive compositions comprising a barium neodymium oxide may have the same chemical and/or physical compositions previously described in relation to the discussion of the electrodes per se, above. Similarly, the electrodes in such lamp may also have the same structures and/or configurations previously described in relation to the discussion of the electrodes per se, above.

Some non-limiting examples of materials which may comprise the discharge fill of lamps include at least one material selected from the group consisting of Hg, Na, Zn, Mn, Ni, Cu, Al, Ga, In, Tl, Sn, Pb, Bi, Ti, V, Cr, Zr, Nb, Mo, Hf, Ta, W, Re, Os, Ne, Ar, He, Kr, Xe and combinations and compounds thereof, or the like. In particular, where a substantially mercury-free discharge fill is desired, the discharge fill may comprise at least one material selected from the group consisting of a gallium halide, a zinc halide and an indium halide; or the like.

Non-limiting examples of lamps in accordance with embodiment of the invention include one or more of a linear fluorescent lamp, compact fluorescent lamp, a circular fluorescent lamp, a high intensity discharge lamp, a flat panel display, a mercury free lamp, and a xenon lamp; or the like. Discharge lamps typically include an envelope containing a gas discharge material through which a gas discharge takes place, and typically two metallic electrodes that are sealed in the envelope. While a first electrode supplies the electrons for the discharge, a second electrode provides the electrons with a path to the external current circuit. Electron emission generally takes place via thermionic emission, although it may alternatively be brought about by an emission in a strong electric field (field emission), or directly, via ion bombardment (ion-induced secondary emission).

A discharge fill material may include materials such as buffer gases and ionizable discharge compositions. Buffer gases may include materials such as but not limited to rare gases such as argon, neon, helium, krypton and xenon. Ionizable discharge compositions may include materials such but not limited to metals and metal compounds. In some embodiments, ionizable discharge compositions may include rare gases. Some non-limiting examples of discharge fill materials include those previously cited earlier. In one embodiment, the discharge fill material in a lamp includes mercury. In another embodiment, the discharge fill material in a lamp is mercury free.

In one embodiment, the composition comprising a barium neodymium oxide is provided on a hot cathode electrode. During lamp operation the hot cathode is heated to the thermionic emission temperature of the electron emissive material to provide a source of electrons to support a discharge arc. Hot cathode electrodes are used in "pre-heat", "rapid-start", and "instant start" lamps. In preheat lamps, electrodes are heated to their emission temperature prior to ignition of the lamp by a pre-heat current. In rapid start lamps, ballasts are used to ignite the lamps by simultaneously providing a cathode voltage (to provide heat) and an ignition voltage across the lamp. In instant start lamps, an initial voltage many times greater than the lamp's normal operating voltage and greater than the lamp's break-down resistance is applied. In another embodiment of the present invention, the electrode is a cold cathode and is heated to its emission temperature solely by an arc discharge.

Figure 2:
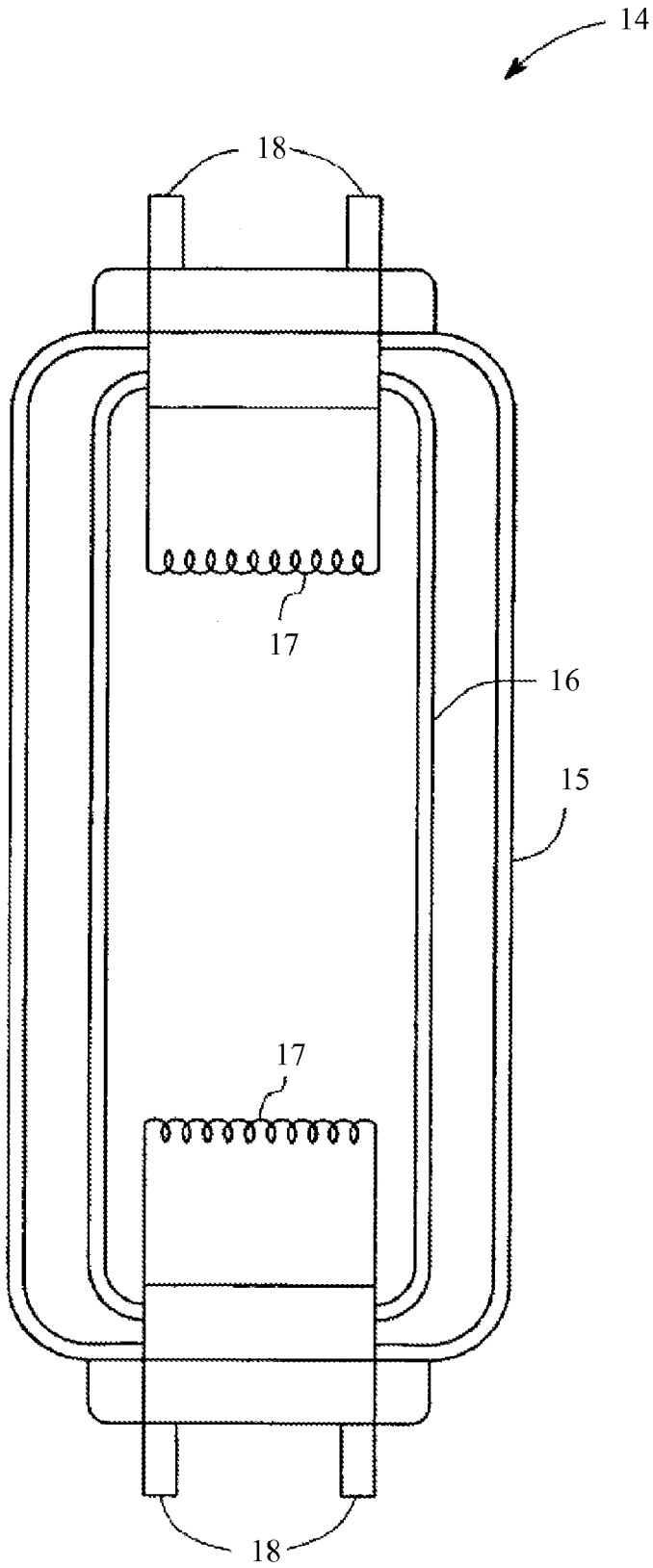
FIG. 2 is a schematic illustration of a discharge lamp according to illustrative embodiments of the invention.

Referring now to FIG. 2, here is shown a side-view schematic illustration of a mercury-free discharge lamp 14. Such lamp 14 may include an outer envelope 15 and an inner envelope 16 enclosing a discharge space, which may comprise the discharge fill materials described previously. Envelopes 15 and 16 may be transparent, semi-transparent, or opaque. The envelopes may have circular or non-circular cross section and need not be straight as illustrated. Either or both of the outer surface of the inner envelope 16 or the inner surface of outer envelope 15, is advantageously provided with a phosphor composition to convert electromagnetic or other radiation into usable visible or UV light. Suitable phosphors are generally known to the person of skill in the field. In the illustrated embodiment, a plurality of electrodes 17 are provided. Each electrode 17 comprises an electrode substrate and an electron emissive composition operable to emit electrons in response to excitation, where the composition comprises a barium neodymium oxide. The electrodes 17 are shown as connected to external current sources 18. A double walled envelope may sometimes be required to thermal insulate the inner tube to allow it to reach a desired operating temperature. However, it is understood that discharge lamps, mercury-free or otherwise, can be constructed in other configurations, including ones with only a single envelope.

Figure 3:
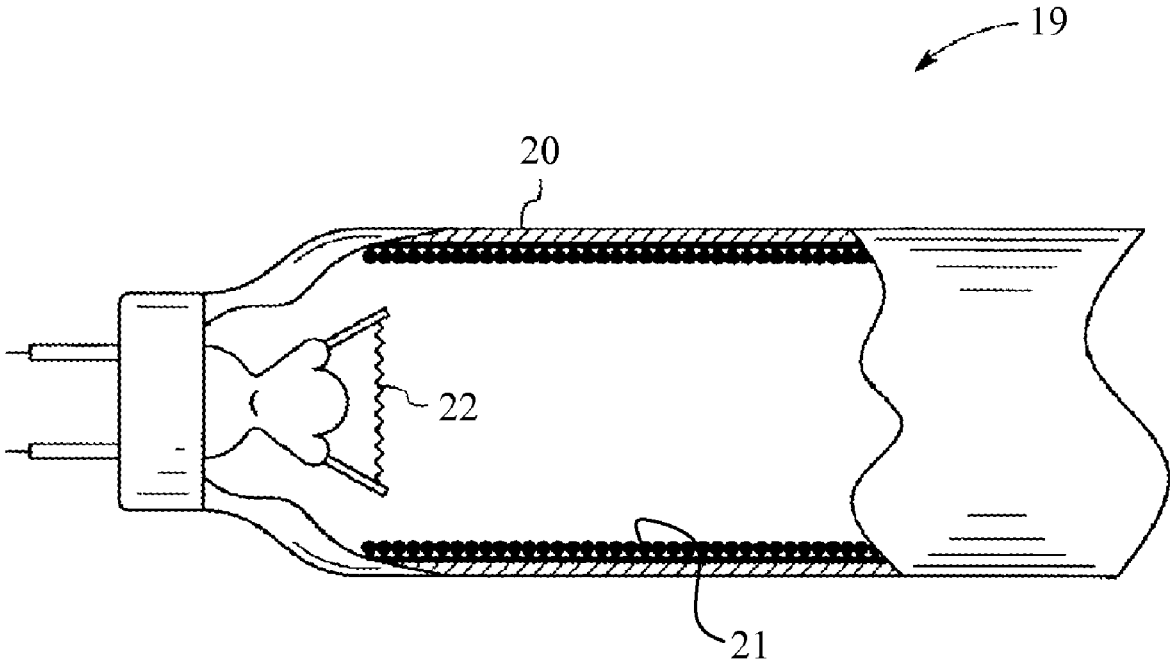
FIG. 3 is a schematic illustration of another discharge lamp according to illustrative embodiments of the invention.

Referring now to FIG. 3 is shown a side-view, schematic, illustration of a typical fluorescent lamp 19 having an single outer envelope 20 defining a discharge space comprising a discharge fill material (not specifically shown). Disposed upon the inner surface of envelope 20 is phosphor layer 21. Also depicted is one of a possible plurality of emissive electrodes 22 comprising a barium neodymium oxide.

EXAMPLES

The example that follows is merely illustrative, and should not be construed to be any sort of limitation on the scope of the claimed invention.

Example 1

Figure 4:
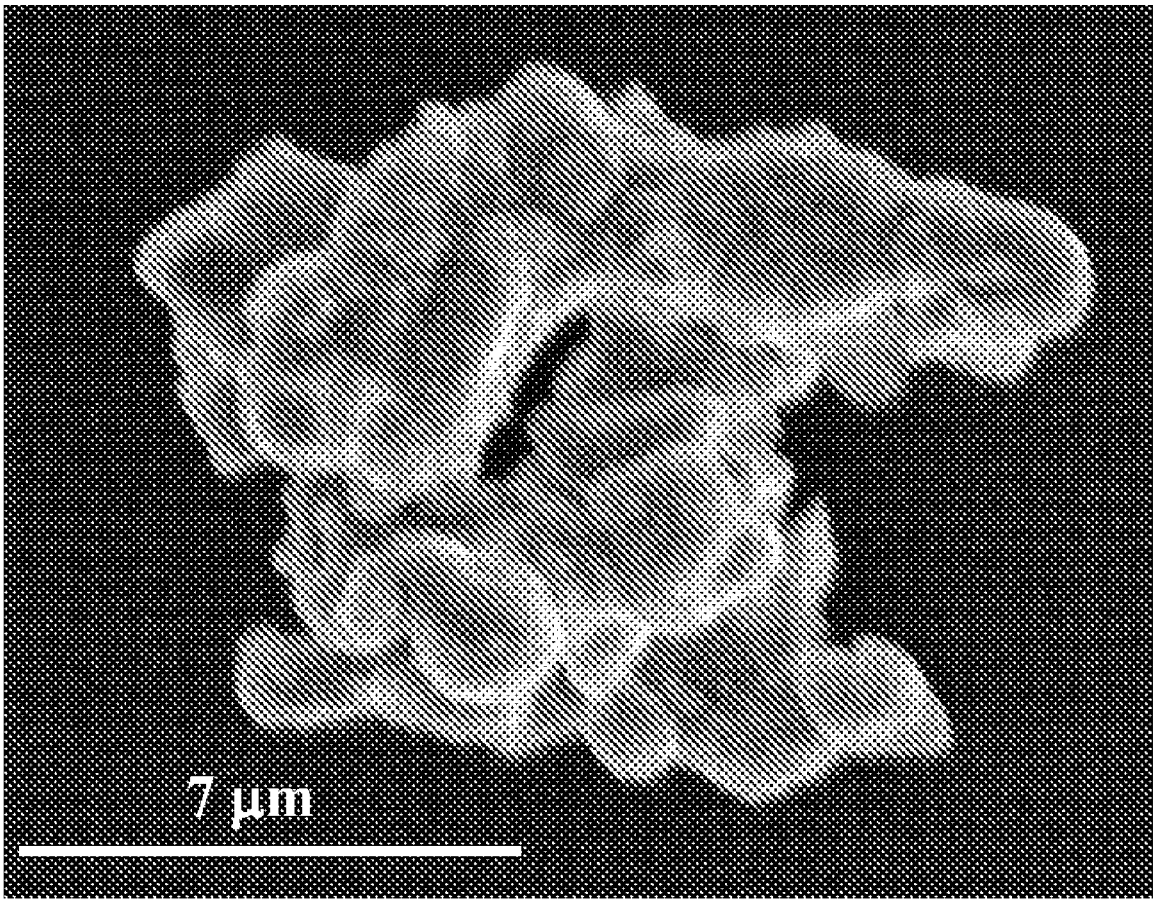
FIG. 4 is a photomicrogram of an emissive composition according to illustrative embodiments of the invention.

A barium neodymium oxide electron emissive material was prepared in accordance with one embodiment of the present invention. Powders of neodymium carbonate ($Nd_2(CO_3)_3$) and barium carbonate ($BaCO_3$) were provided as precursors. The starting $BaCO_3$ crystals had needlelike form and were about 5 micron in length. The diameter of the starting spherical $Nd_2(CO_3)_3$ particles was about 600 nm. A mixture having a 1:1 molar ratio of the carbonates was prepared and then heated in a furnace to 1100° C. for 22 h to generate a barium neodymium oxide. The product was identified as comprising well-crystallized $BaNd_2O_4$ by X-ray diffraction. FIG. 4 shows a scanning electron microscope photomicrogram of the product. Aggregated lamellae of about 3 microns in length, with many small mostly spherical surface objects (each several hundred nm in diameter) were observed in the product.

It is believed that the emissive compositions provided by the present disclosure are able to lessen or avoid unfavorable interactions with components of an ionized halide plasma, which contains many chemically strongly reactive species. Further advantages attendant to the use of the emissive compositions provided by the present disclosure, include longer lamp lifetimes and lessened evaporation of emissive components.

As used herein, approximating language may be applied to modify any quantitative representation that may vary without resulting in a change in the basic function to which it is related. Accordingly, a value modified by a term or terms such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity). "Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed as new and desired to be protected by Letters Patent of the United States is:

1. An electrode comprising:

an electrode substrate; and an electron emissive composition emitting electrons in response to excitation, said composition comprising a barium neodymium oxide.

2. The electrode of claim 1, wherein the excitation comprises thermal excitation, electrical excitation, or combinations thereof.

3. The electrode of claim 1 wherein at least of portion of the electron emissive composition is in contact with the electrode substrate.

4. The electrode of claim 3 wherein at least a portion of the electron emissive composition is coated upon the electrode substrate.

5. The electrode of claim 1 wherein the barium neodymium oxide has the chemical formula $BaNd_2O_{4-x}$ where x is >0 and less than about 0.2.

6. The electrode of claim 1 wherein the barium neodymium oxide has the chemical formula $BaNd_2O_4$.

7. The electrode of claim 1, wherein the electron emissive composition further comprises one or more of an alkaline earth oxide and an alkaline earth carbonate.

8. The electrode of claim 1 wherein the electrode substrate comprises a metallic material selected from the group consisting of W, Ta, Pt, Th, Ti, Ni, V, Hf, Nb, Mo, Zr, Re, and combinations and alloys thereof.

9. A lamp comprising:

an light-transmissive envelope;

a discharge fill contained within said envelope; and an electrode comprising an electrode substrate and an electron emissive composition emitting electrons in response to excitation, said composition comprising a barium neodymium oxide.

10. The lamp of claim 9 wherein the barium neodymium oxide has the chemical formula $BaNd_2O_{4-x}$ where x is >0 and less than about 0.2.

11. The lamp of claim 9 wherein the barium neodymium oxide has the chemical formula $BaNd_2O_4$.

12. The lamp of claim 9 wherein said electrode substrate comprises a metallic foil or metallic filament.

13. The lamp of claim 9, wherein the electron emissive composition further comprises one or more of an alkaline earth oxide and an alkaline earth carbonate.

14. The lamp of claim 9 wherein the electrode substrate comprises a metallic material selected from the group consisting of W, Ta, Pt, Th, Ti, Ni, V, Hf, Nb, Mo, Zr, Re, and combinations and alloys thereof.

15. The lamp of claim 9, wherein the discharge fill comprises at least one material selected from the group consisting of Hg, Na, Zn, Mn, Ni, Cu, Al, Ga, In, Tl, Sn, Pb, Bi, Ti, V, Cr, Zr, Nb, Mo, Hf, Ta, W, Re, Os, Ne, Ar, He, Kr, Xe and combinations and compounds thereof.

16. The lamp of claim 9, where in the discharge fill comprises at least one material selected from the group consisting of a gallium halide, a zinc halide and an indium halide.

17. The lamp of claim 9, wherein the lamp comprises one selected from the group consisting of a linear fluorescent lamp, compact fluorescent lamp, a circular fluorescent lamp, a high intensity discharge lamp, a flat panel display, a mercury free lamp and a xenon lamp.

18. A method of manufacturing an electron emissive system, the method comprising:

(a) blending a composition comprising a barium neodymium oxide and a binder, to form a slurry or suspension:

(b) coating the slurry or suspension on a thermal or electrical excitation source to form a coated excitation source; and (c) removing the binder from the coated excitation source.

19. The method of claim 18, further comprising a step of activating the coated excitation source.

* * * * *